United States Patent [19]

Ishizuka

[11] Patent Number: 4,527,778

[45] Date of Patent: Jul. 9, 1985

[54] APPARATUS FOR PRODUCTION OF REFRACTORY METAL FROM A CHLORIDE THEREOF

[76] Inventor: Hiroshi Ishizuka, 19-2, Ebara 6-chome, Shinagawa-ku, Tokyo, Japan

[21] Appl. No.: 477,405

[22] Filed: Mar. 21, 1983

[30] Foreign Application Priority Data

Apr. 6, 1982 [JP] Japan ..... 57-56041

[51] Int. Cl.[3] ..... C21B 7/00

[52] U.S. Cl. ..... 266/171; 75/84.5; 266/168; 266/169

[58] Field of Search ..... 75/84.5; 266/168, 169, 266/171

[56] References Cited

U.S. PATENT DOCUMENTS 3,519,258 7/1970 Ishizuka ..... 75/84.5

3,715,205 2/1973 Ishizuka ..... 75/84.5

*Primary Examiner*—Peter D. Rosenberg

*Attorney, Agent, or Firm*—Larson and Taylor

[57] ABSTRACT

An apparatus and method for production of refractory metal from a chloride thereof, comprising a conversion assembly and a purification assembly, the former in turn comprising: an elongated vertical cylindrical member with an open top and a closed bottom, another cylindrical member open at each end but having a grid plate detachably supported at a bottom thereof, said cylindrical members consisting of axially arranged outer and inner vessels, respectively, an annular top cover joined on respective upper ends of said outer and inner vessels, a closure joined over a central bore of said top cover, a furnace means surrounding said outer vessel, a tube means which extends through the closure into the inner vessel for feeding raw chloride, another tube means which opens in the outer vessel at a bottom thereof and extends along a wall thereof outwards for discharging fluids, and a means for evacuation and introduction of inert gas; while the purification assembly comprising: an elongated vertical cylindrical retort which is separable into a coolable upper half and a heatable lower half, a cylindrical member open at each end thereof to consist another inner vessel coaxially arranged inside the retort, another top cover joined on respective upper ends of the retort and inner vessel, another closure joined over a central bore of the top cover, a furnace means surrounding the retort lower half, a water jacket on the retort upper half, and a duct means connected with the closure for degassing the retort, said inner vessels being of a common construction to each other, and the top cover of the purification assembly, as well as the closure, being secured air-tightly but detachably to the retort and the inner vessel by a mechanical means adaptable to secure the top cover and closure to the outer and inner vessels of the conversion assembly, respectively.

5 Claims, 4 Drawing Figures

APPARATUS FOR PRODUCTION OF REFRACTORY METAL FROM A CHLORIDE THEREOF

Figure 1:
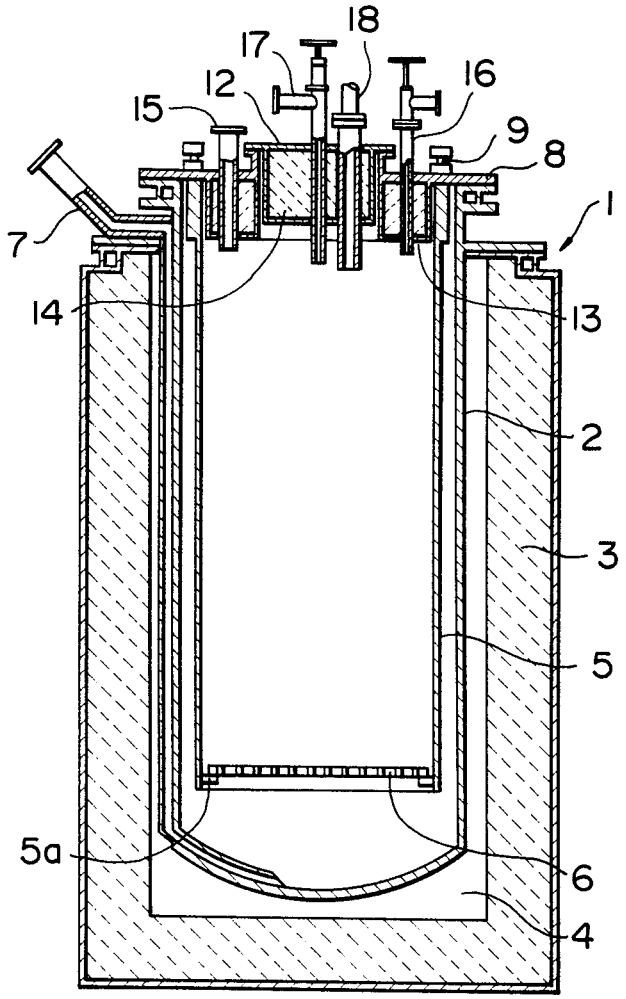

The present invention relates to improvement in production of refractory metal, such as titanium or zirconium, from a chloride thereof such as $TiCl_4$ or $ZrCl_4$. The invention in particular relates to an apparatus and a method of operation thereof, which permit an efficient sequence of conversion and purification processes where the metals are converted from the chlorides by means of fused magnesium as reducing medium and then purified by distillation in a vacuum.

Refractory metals such as titanium and zirconium are commonly produced on an industrial scale by so-called Kroll processes, whereby their chlorides are reduced with fused magnesium. Various apparatus designs have ever been proposed and put in use. Among them included are double-cylindrical arrangements which basically comprise a pair of cylindrical members arranged one inside the other coaxially for holding liquid magnesium and for supporting and transferring solid product metal, respectively. The product metal, recovered in mixture with magnesium chloride byproduct and magnesium metal, is then subjected to a distillation process in a vacuum for removing such contaminants in such a way as described in, for example, U.S. Pat. No. 3,663,001. The above design is advantageous principally in facilitated recovery of the product metal and ready removal of the contaminants, that is, magnesium metal and chloride ($MgCl_2$). However, the arrangements also have drawbacks: transfer of the inner vessel from the conversion to purification process has heretofore been a troublesome and inefficient step. A high airtightness must be realized in the inner member above the bath level in order to prevent raw chloride vapor from penetrating the interspace between the two cylindrical members to cause clogging and difficult removal of the inner member from the outer one. The inner member usually has a narrow elongated top, or a neck, through which the member is supported by an outer frame construction. The neck is cut for removal and joined by welding for assembly of this cylindrical member in each cycle with skill and labor, taking such long time that magnesium chloride in the depositing mass absorbs atmospheric humidity, thus causing increased contaminant level with respect of oxygen and/or hydrogen.

Alternatively, the sequential processes of conversion and purification are practised in a unitary construction such as illustrated in U.S. Pat. No. 3,684,264, which comprises upper and lower halves with an outward regulatable valve therebetween. The lower half is heatable for the conversion process and, during the purification process, for evaporation of such contaminants as magnesium metal and magnesium chloride, while the upper half is coolable for condensing to deposit the contaminants. This arrangement is advantageous in that no troublesome handling is necessary between the two processes and improved power efficiency may be achievable as a result of saved cooling and re-heating of depositing mass before the latter process is conducted. The design, however, is disadvantageous in that a sophisticated means is required for dividing the two sections and rather an increased height of the setup necessitates a housing enlarged accordingly.

Whether a single or double cylindrical construction is employed, the conversion process is usually conducted using magnesium in excess of the stoichiometric amount for minimizing possible formation of lower chlorides, such as $TiCl_2$ or $TiCl_3$, which result in lowered yields of product metal. Thus a substantial amount of magnesium remains mainly in pores and cavities of the product in spongy form when the conversion process is terminated. The magnesium is wastefully discharged from the retort in a mixed fluid with $MgCl_2$ for achieving an improved power efficiency in the purification process.

Therefore, one of the main objects of the invention is to provide an apparatus for production of refractory metals, or titanium or zirconium in particular, which allows facilitated transfer of a member which supports the product metal from a conversion to purification assembly, thus permitting a substantial improvement in both labor and time, and as a result, product yield or quality without causing substantial increase in construction cost.

Another object is to provide a method for operation well adapted to such apparatus.

According to the invention there is provided an apparatus which comprises a conversion assembly and a purification assembly, the former in turn comprising: an elongated vertical cylindrical member with an open top and a closed bottom, another cylindrical member open at each end but having a grid plate detachably supported at a bottom thereof, said cylindrical members consisting of axially arranged outer and inner vessels, respectively, an annular top cover joined on respective upper ends of said outer and inner vessels, a closure joined over a central bore of said top cover, a furnace means surrounding said outer vessel, a tube means which extends through the closure into the inner vessel for feeding raw chloride, another tube means which opens in the outer vessel at a bottom thereof and extends along a wall thereof outwards for discharging fluids, and a means for evacuation and introduction of inert gas; while the purification assembly comprising: an elongated vertical cylindrical retort which is separable into a coolable upper half and a heatable lower half, a cylindrical member open at each end thereof to consist another inner vessel coaxially arranged inside the retort, another top cover joined on respective upper ends of the retort and inner vessel, another closure joined over a central bore of the top cover, a furnace means surrounding the retort lower half, a water jacket on the retort upper half, and a duct means connected with the closure for degassing the retort, said inner vessels being of a common construction to each other, and the top cover of the purification assembly, as well as the closure, being secured airtightly but detachably to the retort and the inner vessel by a mechanical means adaptable to secure the top cover and closure to the outer and inner vessels of the conversion assembly, respectively.

Such apparatus is most effectively operated in the following way. The method, which consists another aspect of the invention, comprises: providing a conversion assembly such as specified above, holding fused magnesium at a level above the grid plate, feeding raw chloride to the magnesium, thus initiating a reaction therebetween to form the refractory metal product and magnesium chloride byproduct, depositing said product in an inner vessel (1), discharging the byproduct for some part in liquid state so that magnesium overlying the byproduct may exhibit a lowered level, discontinuing supply of the raw chloride to terminate the conversion step at a timing where the magnesium remains unconsumed for some part, cooling and removing the inner vessel (1) with a mixed mass of product, byproduct and magnesium loaded and the top cover joined thereto, providing a purification assembly such as specified above but with the retort upper half removed, placing the inner vessel (1) in the retort lower portion, removing the top cover from said vessel (1), putting on the retort upper half, another inner vessel (2), a top cover and a closure with a duct means, all assembled in advance, over the lower half of the retort, degassing said retort to an elevated vacuum, providing such a temperature condition in the retort that magnesium chloride and magnesium metal evaporate to ascend from the vessel (1) and deposit on the inner vessel (2) upwards, taking out said vessel (2) from the retort with the top cover secured thereto, joining the vessel (2) with the outer vessel, top cover, closure, and grid plate to set up the conversion assembly, replenishing fused magnesium to a level above the grid plate, and resuming the conversion run, while refractory metal product is recovered from the inner vessel (1) with a pressing mechanism after the vessel (1) has been taken from the purification retort.

In the invention the top covers, inner cylindrical members, or inner vessels and closures as well as conversion outer vessel and purification retort, are provided which have common designs to each other, so that compatible mechanism may be available for securing and setting up the respective assemblies. In particular, corresponding members comprise bolt holes provided on similar reference circles at a pitch or pitches identical to each other. Conveniently the purification retort may have a somewhat decreased number of such holes provided at pitches a few times larger but anyhow meeting some holes of the cover, relative to the conversion retort. For convenience in construction, every corresponding members may be of an entirely similar design with respect to the geometry and dimensions. Such holes are run with high strength bolts to secure an airtight but detachable joint of the members. In addition to bolting, a secondary means can be provided for facilitated alignment of the members to be joined and improved airtightness therebetween. Such means, described later in detail, will also be known from Japanese Patent No. Sho 57-192234 (1982).

Top covers are joined with a closure over the central bore, said closure being provided with either a tube extending therethrough for supplying raw chloride to the conversion assembly or a terminal member of exhaust duct for the purification retort.

For introduction of fused magnesium to the conversion outer vessel, although the former may be first charged as solid and then fused in situ, another tube means is preferably arranged in the closure in addition to or exchangeably with the one for the raw chloride, or otherwise extending into the inner cylindrical member.

It is advantageous that, for receiving bolts, the inner cylindrical member have a wall thickness somewhat increased at a top end thereof while consisting the rest at a decreased thickness for minimizing increase in weight while ensuring sufficient strength.

A duct means may be advantageously arranged along the wall of the conversion outer vessel for discharging megnesium chloride byproduct in fused state.

With a deposit of mixed mass from a conversion process, the inner vessel is taken out from the retort on termination of the process, and with a top cover unremoved therefrom the member then is set in a purification retort, which by then has been divided at a bottom thereof.

As a result of decreased requirement of time, the conversion mass in the cylindrical member is exposed to atmospheric moisture only for a substantially decreased period of time, permitting product to be recovered at decreased levels of contaminants such as oxygen and hydrogen.

Contaminants of magnesium metal and chloride and magnesium metal ascend the purification retort as evaporated from the mass at the bottom and are condensed to deposit on the inside surface of another cylindrical member provided in the upper section. This vessel, so deposited, is taken out, on termination of purification process, and transferred to the conversion assembly in joint with a grid plate at the bottom. Magnesium portion of the deposit will serve as reducing medium in the subsequent process, while the magnesium chloride is discharged as fused together with in-situ formed chloride, so any additional step is unnecessary for removal of such deposits.

Other objects and features of the invention will be better understood from the following description taken in reference with the attached drawing, which is given merely by way of example.

Figure 2:
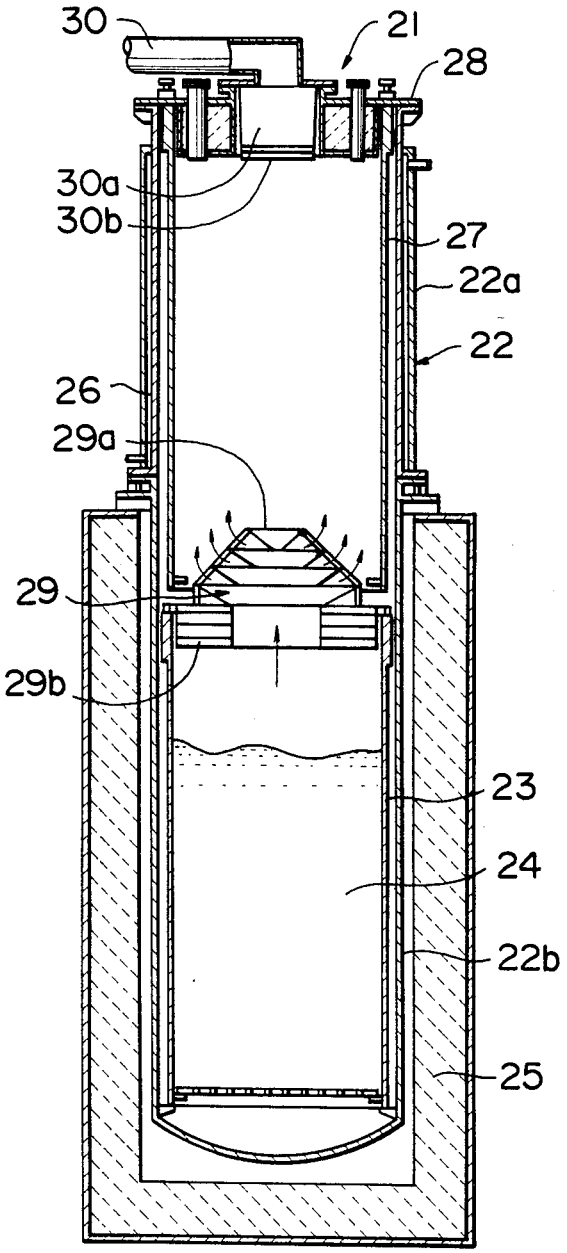

FIGS. 1–3 schematically illustrate an apparatus constructed according to the invention and adapted especially to production of titanium metal from titanium tetrachloride ($TiCl_4$). In particular, FIG. 1 shows a sectional elevation of a conversion assembly, FIG. 2 shows such view of a purification assembly, and FIG. 3 shows in detail a few of arrangements applicable to fixation of the top cover with the inner vessel and either a retort or a conversion outer vessel.

FIG . 3(*a*) shows a cover having a circular groove.

FIG. 3(*b*) shows a cover with a collar-like prodjection.

Figure 3A:
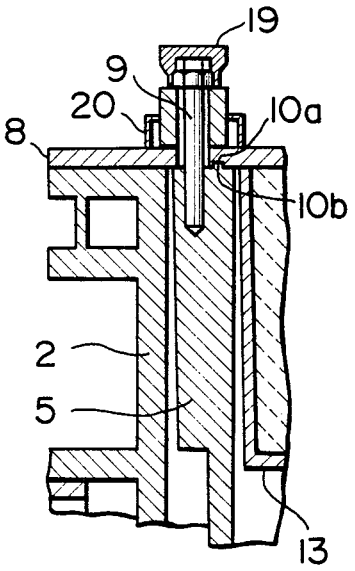
Figure 3B:
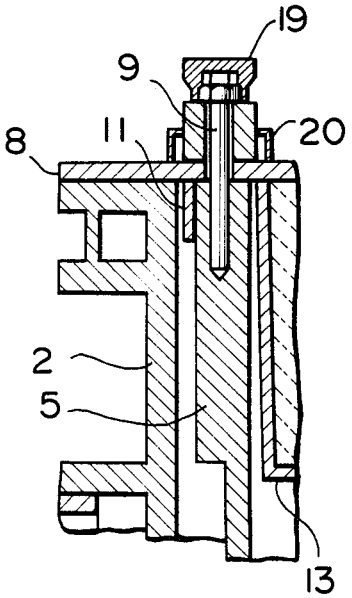

In the figures the conversion assembly generally designated at 1 comprises an outer vessel 2 which consists of a substantially cylindrical one, with a closed bottom, and is heatable by an electroresistive furnace 3 arround. The interspace 4 between the outer vessel 2 and the furnace 3 is open to the atmosphere or, preferably, closed airtightly and provided with a pressure controlling means (not shown). An inner vessel 5, or a cylindrical member coaxially arranged inside the outer vessel 2 comprises an open top and a bottom which is open but supports a detachable grid plate 6 on several stoppers 5*a*. For an efficient rise of magnesium over downcoming magnesium chloride an elongated narrow sleeve (not shown) can be advantageously placed on the grid plate 6, though not essential to the invention, such sleeve comprising a closed top and a cylindrical or conical face riddled with small holes. A duct 7 opens at the bottom and extends outwards along the wall of the outer vessel 2 for discharging fluids which mainly comprise liquid magnesium chloride. The vessels 2, 5 are in an airtight engagement with an annular top cover 8 by means of several threaded bolts 9 running into the vessel 5. An additional secondary engagement means such as shown in FIG. 3 may be provided for facilitated alignment and improved airtightness. For example, the cover 8 may comprise a circular groove 10*a*, with which the vessel 5 is coupled by an annular tenon 10*b* formed on an upper end thereof (FIG. 3*a*). The engagement can be replaced by this: the top cover comprises a short collar-like projection 11 of an inside or outside geometry to fitly match the vessel 5 (FIG. 3*b*). A packing ring of heat resistive material is preferably arranged between the cover 8 and the vessel 5, for an improved sealing capability to be achieved especially in cases where no such additional coupling means are employed. A closure 12 is airtightly joined to the cover 8 over a central bore thereof, secured by bolting with a packing ring inserted therebetween. Each of the cover 8 and the closure 12, comprise, on the lower side, a metallic annular or cylindrical can 13, 14 filled with heat insulative material, through which extend tubes 15, 16, 17, 18 for degassing, introduction of inert gas, feeding raw chloride and, if necessary, introduction of fused magnesium, respectively. It is preferable that the gap between the outer vessel 2 and the can 13 be minimized for improved sealing there. The bolts 9 are sealed with conventional means such as cap nuts 19 welded thereto and cooled with water passing in the jacket 20.

The purification assembly, generally designated at 21, comprises, for example, an elongated vertical space defined by a retort 22 which is separable into upper and lower halves 22*a*, 22*b*. An inner vessel 23 which comes in from a conversion process with a load of mixed mass to be treated, is contained in the lower section 22*b*, which extends somewhat above the vessel 23, and is entirely surrounded by an electroresistive furnace 25. The upper section 22*a* is placed over and secured to the lower section 22*b* with bolts. The upper section 22*a* is coolable with water passing in the jacket 26 and contains another inner vessel 27 of a construction identical to the vessels 5, 23 used in the conversion assembly, for depositing thereon condensates from ascending vapor, in an approximate alignment with the vessel 23 and in a mechanical coupling with the an annular top cover 28 with a can of heat insulative material by a common means with that of conversion assembly.

A means 29 is detachably set at a level between the vessels 23, 27 for minimizing falling apart of once deposited condensates of magnesium chloride and magnesium metal from the vessel 27, which otherwise would take place appreciably due mainly to heat radiation from below during a purification process. In the illustrated example such means 29 substantially comprises a series of conical rings 29*a* of varying diameters supported in alignment with each other and over the central bores of several annular discs 29*b* of steel, the latter being preferably stuffed with a heat insulative mass. A few of other variations will be known from Japanese patent Kokai No. Sho 57-185940 (1982).

The retort 22 is divided for receiving an incoming vessel with a treatable load on, and then re-assembled for the process. The cover 28 is joined to both the retort 22 and the vessel 27 in the same way as the corresponding members 2, 5 of the conversion assembly. The top cover 28 is joined with a terminal member 30*a* of an exhaust duct 30 over the central bore, so that the member 30*a* may also serve as a closure for the latter. The joint there, too, is realized detachably but hermetically in the same way as the closure 12 of the conversion assembly. The duct 30, of a rather large caliber, is connected with a vacuum pump (not shown) at other end. The terminal member 30*a* has inside several baffles 30*b* for minimizing outflow of vapor of magnesium metal and chloride.

EXAMPLE

An apparatus was used which comprised conversion and purification assemblies basically illustrated in FIGS. 1 and 2, respectively. Top covers were fixed to inner vessels in the way shown in FIG. 3(*a*). The conversion assembly comprised an outer vessel which measured 1.6 m in I.D., 32 mm in wall thickness and 5 m in length, and an inner vessel, 1.5 m in I.D., 16 mm (but 50 mm at the top) in wall thickness, and 3.7 m in length, each consisting of stainless steel. The vessel has a grid plate which was detachably supported at the bottom by stoppers, and an annular top cover of an SS grade (JIS) carbon steel, fixed with sixteen bolts 24 mm thick of high tensile steel running into the thickened wall. The cover was also joined to the outer vessel with several bolts running through holes provided on an outer periphery of the cover. A circular closure was set over the cover bore, with a tube running therethrough for feeding raw material, $TiCl_4$. Each of the cover and the closure had a can filled with a heat insulative mass such as pearlite and secured on the lower sides. The assembly of substantially coaxial vessels with the cover and closure joined together was set in an electroresistive furnace which measured 5.5 m in length and 2.1 m in I.D., and comprised an iron shell thereon.

The purification assembly, on the other hand, comprised a retort of stainless steel, which consisted of an upper half 2.85 m long and a lower half 5 m long and 32 mm thick, each having a 1.6 m I.D. The upper half was coolable with a water jacket thereon, thus serving as a condensation section, while the lower half was entirely placed in the furnace.

The conversion retort was degassed, filled with argon and then heated to 800° C. On introduction of 7.8 tons of fused magnesium to the conversion outer vessel, $TiCl_4$ was added in liquid state at a rate of 200 l/h, thus initiating a reaction therebetween. While water-cooling each bolt top and unloading $MgCl_2$ intermittently, supply of chloride was continued until pressure began to increase in the retort due to a decreased rate of chloride consumption when a total of 12000 l was reached. As remaining unconsumed for some part, magnesium was relocated to a bottom portion of the retort by unloading $MgCl_2$ for the major part from the retort, which then was cooled with furnace power turned off.

While the conversion outer vessel was cooled to a temperature which allows handling, the upper section of the purification retort was set up for preparation of the following process. An annular top cover was first joined to an empty inner vessel this time without a grid plate, said cover and cylindrical member being of the same design and dimensions as corresponding members of the conversion assembly, and the cover was then joined with the retort, with bolts of stainless steel run through the very holes that were used for securing corresponding members of the conversion assembly. An exhaust duct was hermetically connected with the cover central bore by a terminal member provided with baffles inside.

When cooled down reasonably, an inner vessel was taken out from the conversion outer vessel, and transferred to the purification assembly with a load of mixed mass of titanium, magnesium metal and chloride and the top cover unremoved therefrom. The vessel was first placed in the retort lower section in a hanging support by the top cover. Four among sixteen bolts which joined the cover and the vessel were removed and replaced by much longer ones, each 1.7 m long. With such bolts connected with respective movable supports and with the other bolts removed, the vessel was brought down to the bottom. The cover was removed, a heat shield device was set over the vessel and the retort upper half, as assembled to the extent said above, was placed and airtightly secured by bolting.

The retort thus assembled was degassed and then heated to a temperature between 950° and 1000° C. in the lower section by the furnace and water-cooled in the upper section. A vacuum of $3\times10^{-3}$ was reached in about 40 hours from the onset. The above temperature level was maintained for 70 hours to complete the process. After cooled down the retort was divided. With the exhaust duct terminal removed and the top cover unbolted from the retort but secured to the inner vessel, the latter held condensates of magnesium metal and chloride on the inside surface was taken out from upwards, joined with a grid plate at the bottom, and transferred to the conversion assembly into the retort which comprised a leftover of magnesium at the bottom. A cover was bolted and secured to the retort, and joined to a closure over the bore. Fused magnesium was replenished for another conversion run.

The inner vessel was taken from the lower section of the purification retort with contents held on the grid plate. Such vessel was pushed for product recovery with a hydraulic press, and as a result, 5.1 tons of sponge titanium was obtained which exhibited a substantially decreased contaminant level in oxygen and hydrogen. Thus evacuated, the vessel was placed in the upper half of the purification retort after joined to a top cover and an exhaust duct terminal for another purification process. The grid plate recovered was kept dry until such vessel came out again and was used in combination therewith for another conversion process.

As may have been understood, the present invention permits:

1. improved metallic product of a lowered hardness to be obtained due to decreased contents of oxygen and/or hydrogen: The product metal in transfer from the conversion to purification assembly is essentially prevented from contact, on the surface, with atmospheric moisture or air as effectively blocked by the top cover and, on the lower surface in the vicinity of the grid plate, by an intervening minor amount of anyway discardable product of a poor quality due to occlusion of contaminants deriving from technical magnesium used as reducing medium; while open pores are stuffed with magnesium metal and/or its chloride. Further the top cover must be removed only for a very short time, within which the vessel holding such mixed mass can be contained and the purification assembly can be completed, so that a substantial part of product metal is free from contamination by atmosphere.

2. condensates of magnesium metal and chloride on the vessel to be readily recovered and effectively used: A substantially decreased time necessary for setting and dismembering the assemblies permits transfer of such condensates on the inner vessel before the former can be substantially deteriorated by atmospheric moisture and air. Essentially clean, magnesium metal can be used as reducing medium in the next conversion run, while magnesium chloride can be discharged together with in-situ formed chloride. That also saves troublesome handling which would otherwise be necessary for stripping the condensates.

3. improvement to be achieved in labor and time as well as decreased contamination of resulting product: Only a simplified and facilitated handling, such as bolting and unbolting, is necessary in the place of heretofore used troublesome cutting and skillfull welding.

I claim:

1. Apparatus for production of refractory metal from a chloride thereof, comprising a conversion assembly and a purification assembly separated from each other; said conversion assembly comprising: an elongated vertical cylindrical member with an open top and a closed bottom, another cylindrical member open at each end but with a grid plate detachably supported at a bottom thereof, said cylindrical members forming coaxially arranged outer and inner vessels, respectively, an annular top cover at the upper ends of said inner and outer vessels, a closure joined over a central bore of said top cover, mechanical means for detachably and airtightly joining said top cover to the upper end of said inner vessel, mechanical means for detachably and airtightly joining said top cover to the upper end of said outer vessel, furnace means surrounding the outer vessel, tube means extending through said closure for feeding raw chloride into the inner vessel, another tube which is open in the outer vessel at the bottom thereof and extends along a wall thereof outwards for discharging fluids from said outer vessel, and means for evacuation and introduction of inert gas; said purification assembly comprising: an elongated vertical cylindrical retort which comprises an upper half coolable with a water jacket arranged thereon and a lower half heatable with a furnace means therearound, and a cylindrical member of substantially the same construction as the inner vessel, said cylindrical member being in a coaxial relation inside the upper half of said retort, a further annular top cover at the upper ends of said cylindrical member and of said retort, mechanical means for detachably and airtightly joining said further top cover to the upper end of said cylindrical member, mechanical means for detachably and airtightly joining said further top cover to the upper end of said retort, said top cover being of substantially the same construction as that of the top cover of the conversion assembly, and having a central bore joinable with a closure to which a duct is connected for degassing said retort, said mechanical means for joining the further top cover and retort of the purification assembly being compatible with the mechanical means for joining the top cover and outer vessel of the conversion assembly.

2. Apparatus according to claim 1 wherein said top cover and further top cover each comprises a circular row of bolt holes on similar reference circles and wherein said mechanical means comprises a plurality of bolts passed through said bolt holes and into, respectively, the upper end of said outer vessel and the upper end of said retort.

3. The apparatus as recited in claim 2, in which said bolts are common in number between the conversion and purification assemblies.

4. The apparatus as recited in claim 2, in which said bolts are different in number between the conversion and purification assemblies.

5. Apparatus according to claim 1 wherein said mechanical means for joining the further top cover and cylindrical number of the purification assembly is compatible with the mechanical means for joining the top cover and inner vessel of the conversion assembly.

* * * * *